US010174522B2

(12) United States Patent
Denison et al.

(10) Patent No.: US 10,174,522 B2
(45) Date of Patent: Jan. 8, 2019

(54) VENDING MACHINE LOCK WITH MOTOR CONTROLLED SLIDE-BAR AND HOOK MECHANISM AND ELECTRONIC ACCESS

(71) Applicant: TriTeq Lock and Security, L.L.C., Elk Grove Village, IL (US)

(72) Inventors: William Denison, Lake Zurich, IL (US); Gary L. Myers, Monee, IL (US); Richard Paeth, St. Charles, IL (US); Catalin Captarencu, Wheeling, IL (US); Calin V. Roatis, Long Grove, IL (US)

(73) Assignee: TriTeq Lock and Security, L.L.C., Elk Grove Village, IL (US)

( * ) Notice: Subject to any disclaimer, the term of this patent is extended or adjusted under 35 U.S.C. 154(b) by 0 days.

(21) Appl. No.: 14/531,771

(22) Filed: Nov. 3, 2014

(65) Prior Publication Data

US 2015/0069765 A1 Mar. 12, 2015

Related U.S. Application Data

(63) Continuation of application No. 11/102,439, filed on Apr. 8, 2005, now Pat. No. 8,876,172, which is a (Continued)

(51) Int. Cl.
*E05C 1/06* (2006.01)
*E05B 47/02* (2006.01)
(Continued)

(52) U.S. Cl.
CPC ..... *E05B 47/0012* (2013.01); *E05B 47/026* (2013.01); *G07F 5/26* (2013.01);
(Continued)

(58) Field of Classification Search
CPC ..... E05B 47/0012; E05B 47/026; G07F 5/26
See application file for complete search history.

(56) References Cited

U.S. PATENT DOCUMENTS 2,943,880 A * 7/1960 Joachim ..... E05B 81/20 292/201
3,521,920 A * 7/1970 Morand ..... E04H 13/00 27/17

(Continued)

FOREIGN PATENT DOCUMENTS

FR 2667105 A1 * 3/1992 ..... E05B 47/0012
JP 03266096 A * 11/1991

OTHER PUBLICATIONS

Computer Generated Translation for FR 2667105, generated on Feb. 1, 2017, http://worldwide.espacenet.com.*

(Continued)

*Primary Examiner* — Alyson M Merlino
(74) *Attorney, Agent, or Firm* — Charles T. Riggs, Jr.

(57) ABSTRACT

An enhanced slide and hook locking mechanism control system for vending machines and the like that utilizes a reversible motor and worm gear drive that operates the slide and book mechanism. The worm drive is coupled to the slide through a crankshaft type of interconnection. Or as alternatives, the slide means can be gear driven or it may be connected using push-pull type of cable or rod. An electronic control with a microcomputer interface drives the motor control and the system may be operated by a keypad or a remote wireless control device.

24 Claims, 12 Drawing Sheets

Related U.S. Application Data continuation-in-part of application No. 11/073,184, filed on Mar. 3, 2005.

(60) Provisional application No. 60/618,069, filed on Oct. 12, 2004, provisional application No. 60/550,801, filed on Mar. 5, 2004.

(51) Int. Cl.
*E05B 47/00* (2006.01)
*G07F 5/26* (2006.01)

(52) U.S. Cl.
CPC ..... *Y10T 70/5093* (2015.04); *Y10T 70/5978* (2015.04); *Y10T 70/7113* (2015.04); *Y10T 292/1021* (2015.04); *Y10T 292/1079* (2015.04)

(56) References Cited

U.S. PATENT DOCUMENTS 3,854,310 A * 12/1974 Paull ..... E05B 47/0012 292/201
3,947,060 A * 3/1976 Zimmer ..... E05B 47/0012 292/142
4,031,434 A * 6/1977 Perron ..... G07C 9/00031 361/172
4,167,104 A * 9/1979 Bond ..... E05B 5/003 70/208
4,227,723 A * 10/1980 Rosell ..... E05C 9/002 292/161
4,268,076 A * 5/1981 Itoi ..... E05B 65/461 292/201
4,342,354 A * 8/1982 Leivenzon ..... E06B 9/70 160/133
4,369,442 A * 1/1983 Werth ..... G07F 9/08 194/217
4,500,122 A * 2/1985 Douglas ..... E05B 13/106 292/161
4,509,093 A * 4/1985 Stellberger ..... B60R 25/24 340/10.41
4,594,637 A * 6/1986 Falk ..... G07C 9/0069 361/172
4,609,215 A * 9/1986 Self ..... E05B 51/02 292/144
4,762,348 A * 8/1988 Matsumoto ..... E05B 81/06 292/201
4,779,090 A * 10/1988 Micznik ..... G07C 9/00111 340/13.25
4,803,460 A * 2/1989 Rhee ..... B60R 25/021 340/428
4,917,022 A * 4/1990 Ogasawara ..... E05B 47/0012 109/43
4,926,996 A * 5/1990 Eglise ..... G06K 7/0008 194/205
4,943,757 A * 7/1990 Richter ..... B60J 10/00 318/256
4,993,247 A * 2/1991 Minemura ..... E05B 5/003 292/251
5,035,452 A * 7/1991 Rogers ..... E05B 83/36 292/125
5,054,300 A * 10/1991 Nakahara ..... E05B 81/06 70/262
5,120,094 A * 6/1992 Eaton ..... E05B 65/087 292/159
5,148,691 A * 9/1992 Wallden ..... E05B 47/0012 292/201
5,199,288 A * 4/1993 Merilainen ..... E05B 47/0012 292/144
5,253,903 A * 10/1993 Daley ..... E05C 9/041 292/142
5,339,250 A * 8/1994 Durbin ..... G07F 5/18 221/9
5,349,345 A * 9/1994 Vanderschel ..... G07C 9/00912 340/5.25
5,392,025 A * 2/1995 Figh ..... G08B 13/14 340/5.3
5,394,718 A * 3/1995 Hotzl ..... E05B 47/0012 292/144
5,404,737 A * 4/1995 Hotzl ..... E05B 47/0012 292/144
5,537,013 A * 7/1996 Toyozumi ..... H02H 7/0851 318/283
5,542,720 A * 8/1996 Fleming ..... E05B 63/20 292/32
5,575,515 A * 11/1996 Iwamoto ..... E05B 47/0607 221/154
5,617,082 A * 4/1997 Denison ..... G07C 9/00142 307/10.1
5,639,130 A * 6/1997 Rogers, Jr. ..... E05B 81/20 292/199
5,656,867 A * 8/1997 Kokubu ..... B60R 25/021 180/287
5,680,783 A * 10/1997 Kuroda ..... E05B 17/22 292/201
5,689,160 A * 11/1997 Shigematsu ..... H02H 7/0851 318/281
5,745,044 A * 4/1998 Hyatt, Jr. ..... G07B 15/00 340/5.23
5,774,053 A * 6/1998 Porter ..... A47G 29/141 232/19
5,793,122 A * 8/1998 Dingwall ..... B60R 25/04 200/61.08
5,813,257 A * 9/1998 Claghorn ..... E05B 5/003 292/201
5,841,866 A * 11/1998 Bruwer ..... G06Q 20/341 705/66
5,850,753 A * 12/1998 Varma ..... E05B 47/0047 292/341.16
5,862,593 A * 1/1999 Huang ..... B26D 3/169 30/182
5,915,766 A * 6/1999 Baumeister ..... B04B 7/06 292/201
6,003,910 A * 12/1999 Dupont ..... E05B 81/14 292/201
6,005,487 A * 12/1999 Hyatt, Jr. ..... G07C 9/00103 221/7
6,030,019 A * 2/2000 Stiltner ..... B62D 33/037 292/39
6,038,491 A * 3/2000 McGarry ..... G07F 5/18 700/231
6,068,305 A * 5/2000 Myers ..... E05B 17/0029 292/201
6,116,067 A * 9/2000 Myers ..... B25H 3/028 292/341.16
6,130,611 A * 10/2000 Pellaton ..... G08B 29/22 340/540
6,185,773 B1 * 2/2001 Goedde ..... E05B 47/0012 340/10.1
6,196,037 B1 * 3/2001 Urschel ..... E05B 17/2092 70/278.1
6,282,931 B1 * 9/2001 Padiak ..... G07C 9/00182 292/201
6,318,137 B1 * 11/2001 Chaum ..... E05B 49/002 340/5.67
6,345,533 B1 * 2/2002 Nozoe ..... G01C 19/5607 73/504.12
6,359,547 B1 * 3/2002 Denison ..... B60R 25/102 340/5.73
6,401,050 B1 * 6/2002 Cooke ..... A61B 3/113 345/629
6,483,424 B1 * 11/2002 Bianco ..... E05B 17/0058 340/5.6
6,498,101 B1 * 12/2002 Wang ..... B24B 37/11 216/38
6,564,600 B1 * 5/2003 Davis ..... E05B 47/0669 70/277
6,575,504 B2 * 6/2003 Roatis ..... E05B 17/0029 292/199

(56) References Cited

U.S. PATENT DOCUMENTS 6,580,355 B1 * 6/2003 Milo ..... E05B 47/0012 340/5.7
6,581,986 B2 * 6/2003 Roatis ..... E05B 17/0029 292/199
6,625,644 B1 * 9/2003 Zaras ..... G06F 17/30864 707/E17.108
6,637,784 B1 * 10/2003 Hauber ..... E05B 63/242 292/300
6,658,905 B1 * 12/2003 Hsieh ..... E05B 47/0012 70/107
6,874,828 B2 * 4/2005 Roatis ..... E05B 17/0029 292/144
6,884,871 B2 * 4/2005 Luyten ..... C07K 14/71 435/69.1
6,887,685 B1 * 5/2005 Walke ..... C07K 14/57581 435/252.3
7,009,352 B2 * 3/2006 Yamamoto ..... H02H 7/0851 318/280
7,059,159 B2 * 6/2006 Lanigan ..... B62D 33/0222 292/144
7,109,677 B1 * 9/2006 Gagnon ..... G05B 19/4061 160/29
7,127,847 B2 * 10/2006 Fitzgibbon ..... G07C 9/00182 49/26
7,132,813 B2 * 11/2006 Gregori ..... H02H 7/0851 318/466
2002/0014950 A1 * 2/2002 Ayala ..... E05B 5/003 340/5.6
2002/0017793 A1 * 2/2002 Spiessl ..... D06F 37/42 292/341.16
2002/0024418 A1 * 2/2002 Ayala ..... G07C 9/00309 340/5.26
2002/0024420 A1 * 2/2002 Ayala ..... E05B 5/003 340/5.61
2002/0083747 A1 * 7/2002 Beylotte ..... E05B 17/0029 70/257
2002/0157313 A1 * 10/2002 Fukazawa ..... H02H 7/0851 49/26
2003/0030539 A1 * 2/2003 McGarry ..... G07C 11/00 340/5.9
2003/0094023 A1 * 5/2003 Emiel Van Parys ..... E05B 47/0012 70/257
2003/0127866 A1 * 7/2003 Martinez ..... E05B 17/0029 292/216
2003/0128101 A1 * 7/2003 Long ..... G07F 9/00 340/5.26
2003/0234719 A1 * 12/2003 Denison ..... G07C 9/00309 340/5.23
2005/0193629 A1 * 9/2005 Tsui ..... E05F 15/41 49/26
2005/0248163 A1 * 11/2005 Kim ..... F24C 15/022 292/201

OTHER PUBLICATIONS

Computer Generated Translation for JP 3266096 A, Generated on Jun. 15, 2017, http://dialog.proquest.com/professional/patents/lookuppatent?accountid=161361.*

* cited by examiner

Unlocked to Locked Transition

Unlocked to Locked Transition with Options

VENDING MACHINE LOCK WITH MOTOR CONTROLLED SLIDE-BAR AND HOOK MECHANISM AND ELECTRONIC ACCESS

FIELD OF THE INVENTION

The present invention relates generally to vending machine lock systems that control the movement of the slide and hook mechanism such as in a conventional snack food or glass-front vending machine. More specifically the invention provides an enhanced slide mechanism control, and it may also incorporate a unique access control device such as a keypad access control and/or a remote control device that transmits codes in a wireless medium.

RELATED APPLICATIONS

This application claims priority to U.S. Provisional Application No. 60/618,069, filed Oct. 12, 2004, and incorporates the same by reference in its entirety. It is also related to U.S. Provisional Application No. 60/550,801, filed Mar. 5, 2004, now application Ser. No. 11/073,184, filed Mar. 3, 2005.

BACKGROUND OF THE INVENTION

Snack food and glass-front vending machines today are typically secured with a mechanism comprising of a slide-bar and hooks or the like in the door, which generally extend into the cabinet frame when locked, the motion going from unlocked to locked is typically controlled by a rotatable exterior mounted handle controlled by a mechanical T-handle mechanism, see Minemura U.S. Pat. No. 4,993,247. The handle is prevented from rotating by a mechanical core lock. For example, a slide-bar configuration consisting of one or more bars that is in a retracted position while the door is open and as the door is being closed. Once the door is in the closed position, the operator takes the handle and rotates it typically 90 or 180 degrees (depending on the geometry of the hooks) and the hooks will extend into the catches in the cabinet. To unlock, first the access control device is accessed, the slide-bar and the hooks are moved retracted from the catches, and last the handle is pulled so the door will open. These methods are typically cumbersome and time consuming. In addition, an enclosure as described above will typically have an unattractive looking handle and dial or keypad lock mounted to the exterior of the door.

The object of this invention is to improve on the methods, operation, and the interface of the vending machine locking and the unlocking as described above in addition, the removal of certain components from the outside of the enclosure door will add to the improvements mentioned by providing enhanced security due to a more difficult point of attack and also provide additional exterior surface area to add decorative features to the vending machine door.

This invention is not limited to any particular type, style or application of the enclosure. In addition, although the preferred embodiment of the invention will describe a door with slide bar and hook mechanism interfacing to catches in the cabinet of the enclosure, this invention will also support the opposite arrangement such as a slide bar and hook mechanism in a cabinet that interface into catches in the doorframe, as well as many other types of door, cabinet, and mechanism arrangements as are available. This invention will also support the opposite mechanism arrangement such as (for example) a motor controlling a slide bar consisting of catches (instead of hooks) which would latch and un-latch into one or more hooks (instead of catches). A cable or rod may be used to interface the lock mechanism to the slide bar. In the case of a rod being used it can also be modified to act as the latch itself.

BRIEF SUMMARY OF THE OBJECTS OF THE INVENTION

The first object is to improve the locking and unlocking of the door by removing the need for a handle interfaced to a slide-bar hook mechanism.

The second object is to replace manual movement of the slide-bar with motor control movement of the slide-bar.

The third object is to provide a less user interactive procedure and an easier interface to access and lock the vending machine.

The forth object is to provide a faster method for accessing and locking the vending machine.

The fifth object is to improve the security of the door and remove the point of attack by removing the need for an access control unit (T-handle and lock core) from the door and replace with an electronic remote or removable keypad transmission device.

The sixth object is to provide a more user-friendly electronic, controlled device to access and lock the door.

The seventh object is to provide the above-described features with a device that is battery powered, although the invention is not limited to battery controlled operation.

DETAILED DESCRIPTION OF THE INVENTION

Figure 1:
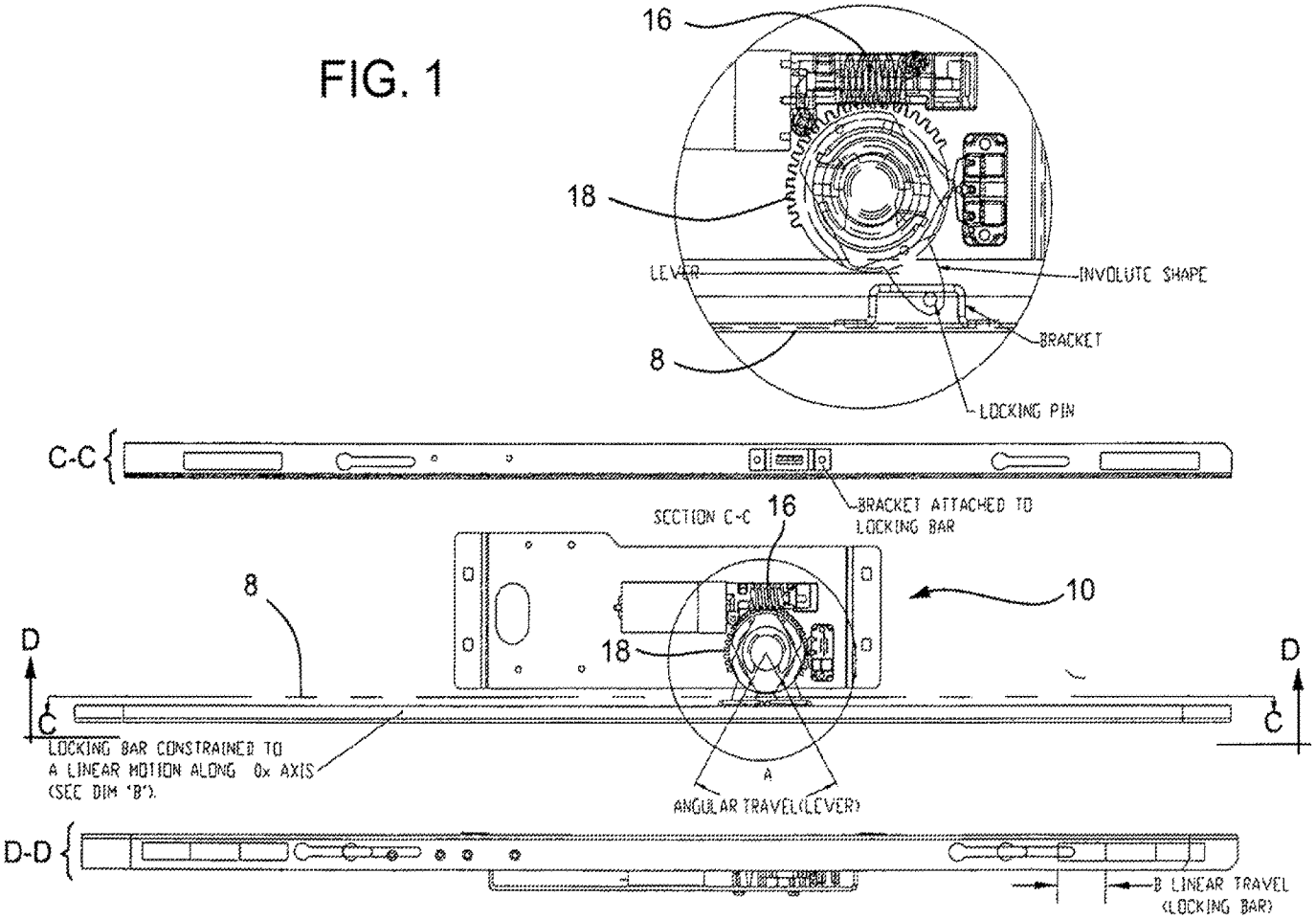
FIG. 1 is an elevational view of the present motor-controlled slide-bar mechanism together with broken out and detail enlarged views taken along the line C-C and for the area D and here showing how it interfaces to the lock-bar.
Figure 2:
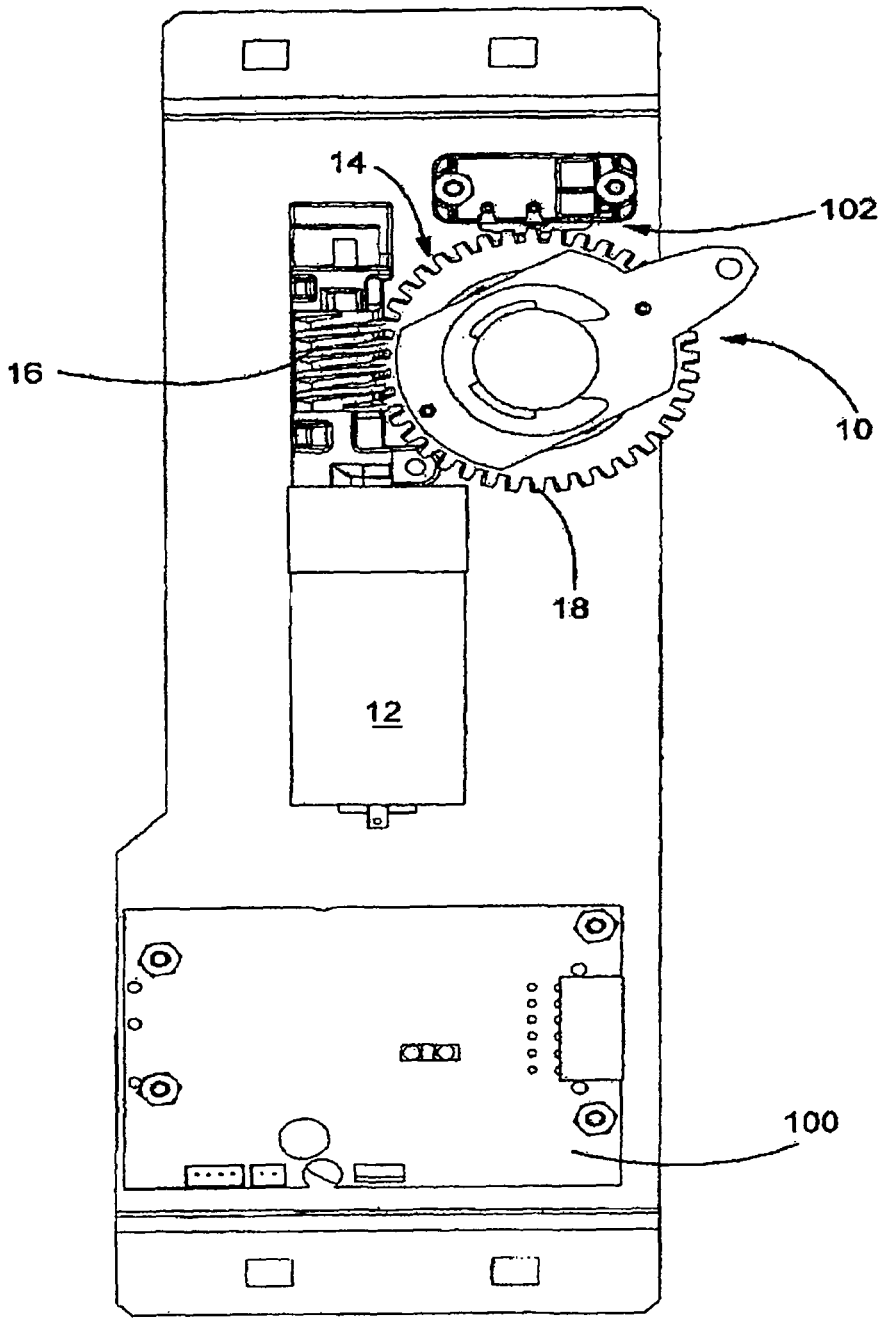
FIG. 2 is a front plan view of the motor controlled slide-bar mechanism locking system.

The prior art is illustrated in U.S. Pat. No. 4,993,247. It would typically consist of a T-handle, a slide-bar mechanism, and the interface of these components. Electronic locking systems are shown in Roatis et al. U.S. Pat. Nos. 6,581,986 and 6,575,504, for example, as used with ordinary lighted doors used on vending machines. Glass front doors can use a locking system similar to a school locker wherein a sliding bar having slots or hooks engage with complimentary slots or hooks.

This invention consists primarily of a motor controlled mechanism to control the movement of the slide-bar mechanism 8 in a vending machine or the like; an electronic control interface to the motor mechanism, an access control device, and a power source.

The motor controlled mechanism 10 is shown in drawing FIGS. 1, 2, 3, 3A and 3B. It serves to eliminate the handle drive system in vending machines, as they exist today. The motorized lock 10 provides a motor 12 to gear reduction 14 system that allows adequate power to control and move the mechanism, and also will hold back several hundreds of pounds of pry pressure if a vandal were to attempt to pry or force a locked mechanism back to the unlocked position by using a pry bar or other tool to push the extended slide-bar back to the retracted position. This is accomplished by gear reducing the motor rotation first through smaller metal gears in the motor mounted gearbox then to a worm-gear 16 to helical gear arrangement 18. The helical gear 18 is interfaced to at least 2 teeth of the worm gear 16 to hold back a considerable force from an external device which tries to push in the mechanism and slide-bar. The interconnection between the helical gear 18 and the slide bar 8 is shown in FIGS. 1 thru 3*a* are representative of a variety of connections available. All known other crankshaft type of mechanisms are applicable to this type of drive.

Figure 3:
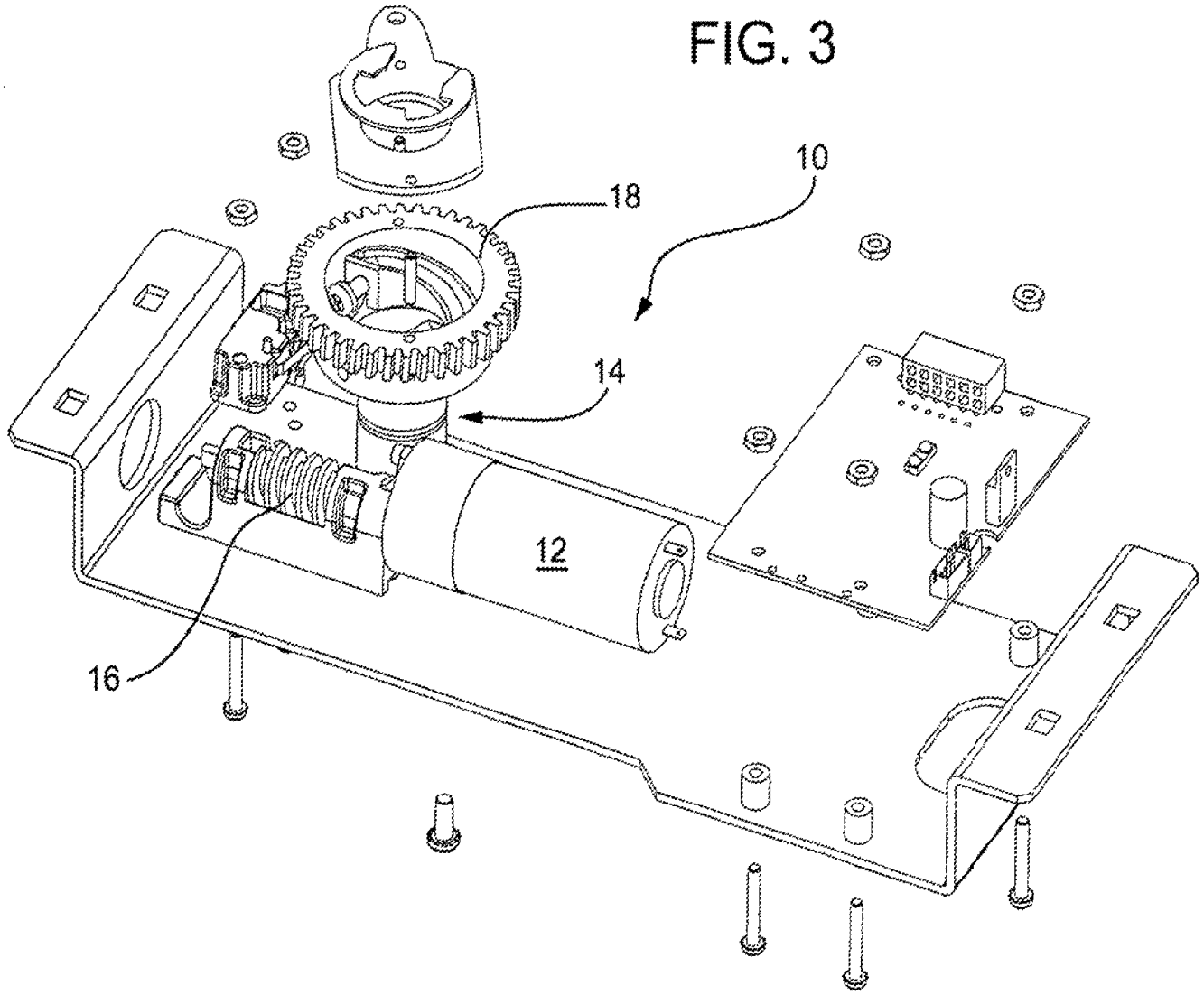
FIG. 3 is an exploded view of the motor and drive for the controlled slide-bar mechanism locking system.
Figure 3A:
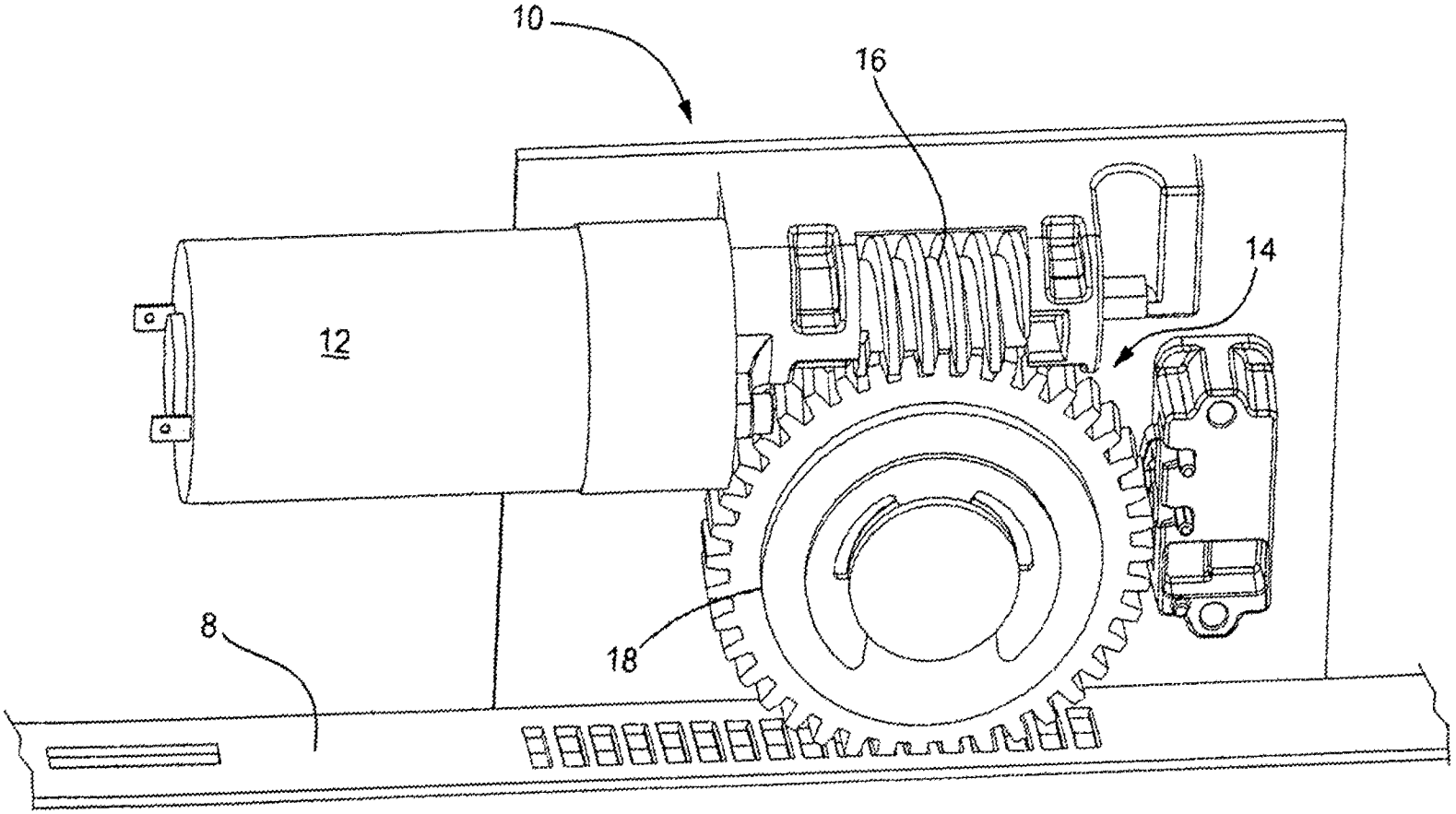
FIG. 3A is a perspective view of an alternate configuration of the mechanism showing how the helical gear can act as a direct interface for the slide assembly.
Figure 3B:
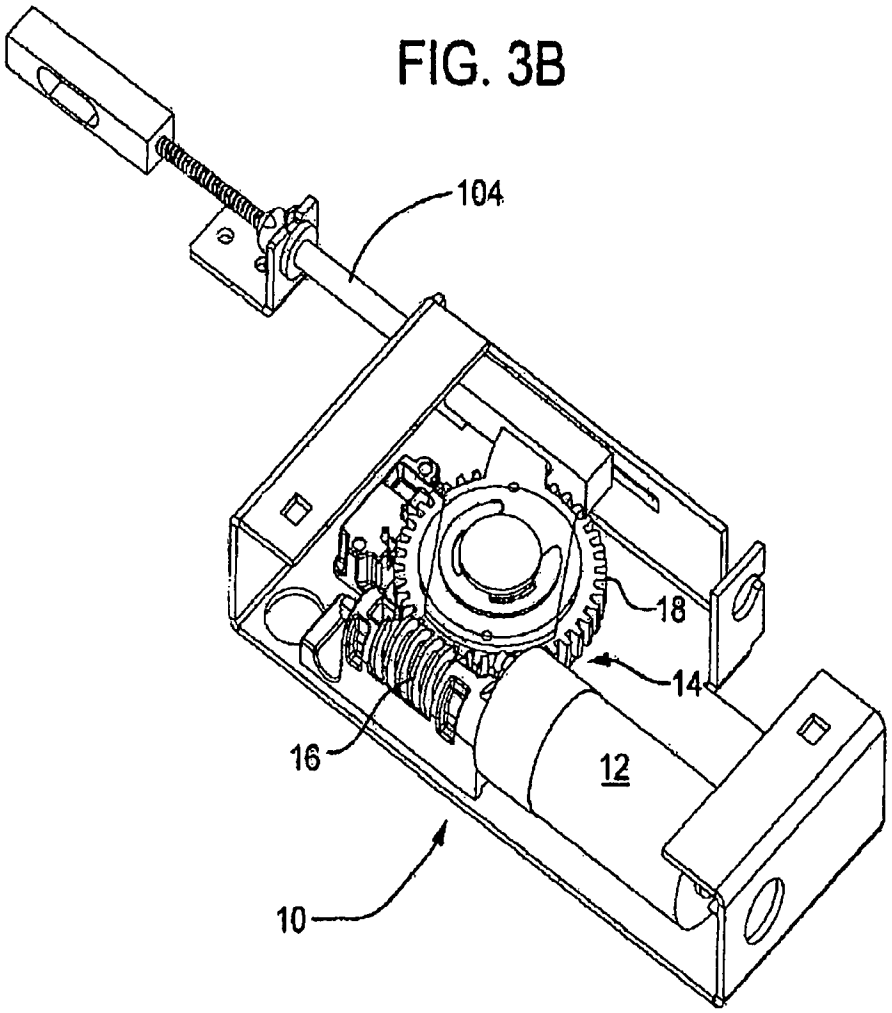
FIG. 3B is a perspective view of an alternate configuration of the mechanism showing a contained drive system.
Figure 4:
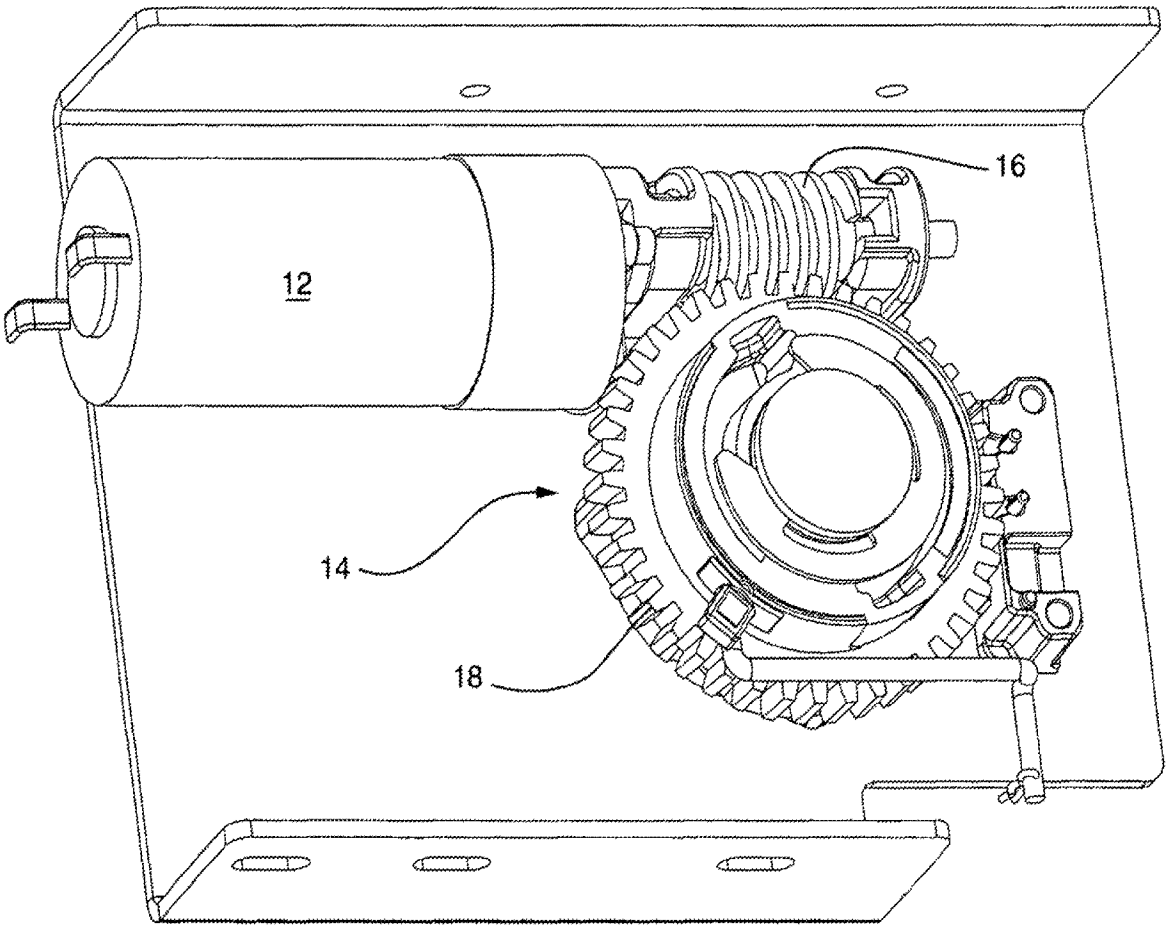
FIG. 4 is a perspective view showing a rod or wire interconnection.
Figure 5:
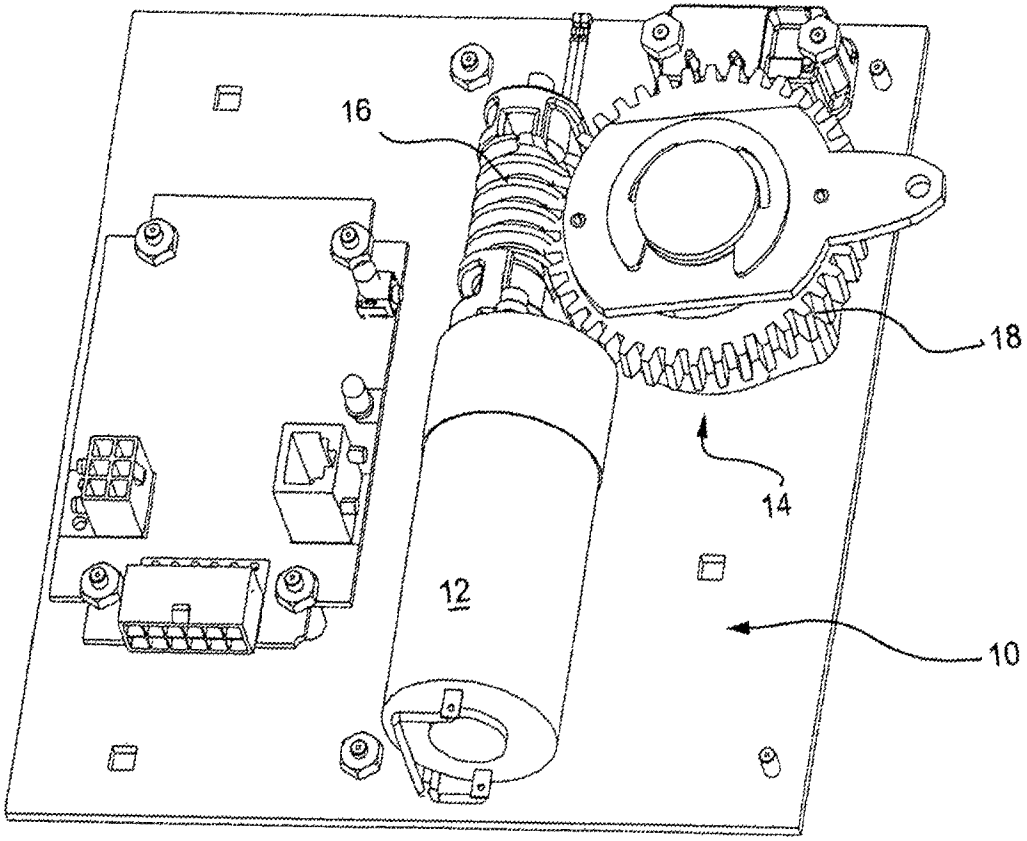
FIG. 5 is a perspective view showing yet another alternate construction and interconnection system as it would be typically installed into a vending machine.

The motor control can also interface into a cable or rod drive system 104 as shown in FIG. 3B. This type of drive allows the mechanism to be placed in a vending machine or the like in a variety of positions where space or direct access to the slide bars is not readily available. The rod as shown can be replaced using a conventional push-pull cable apparatus. The rod or cable assembly can be housed in such a manner as to allow the lock mechanism to be packaged as a singular assembly. This becomes an issue when trying to mount the lock drive unit in snack food vendors. These machines typically do not have access that allows direct connection from the crankshaft drive of the gear assembly.

Figure 6:
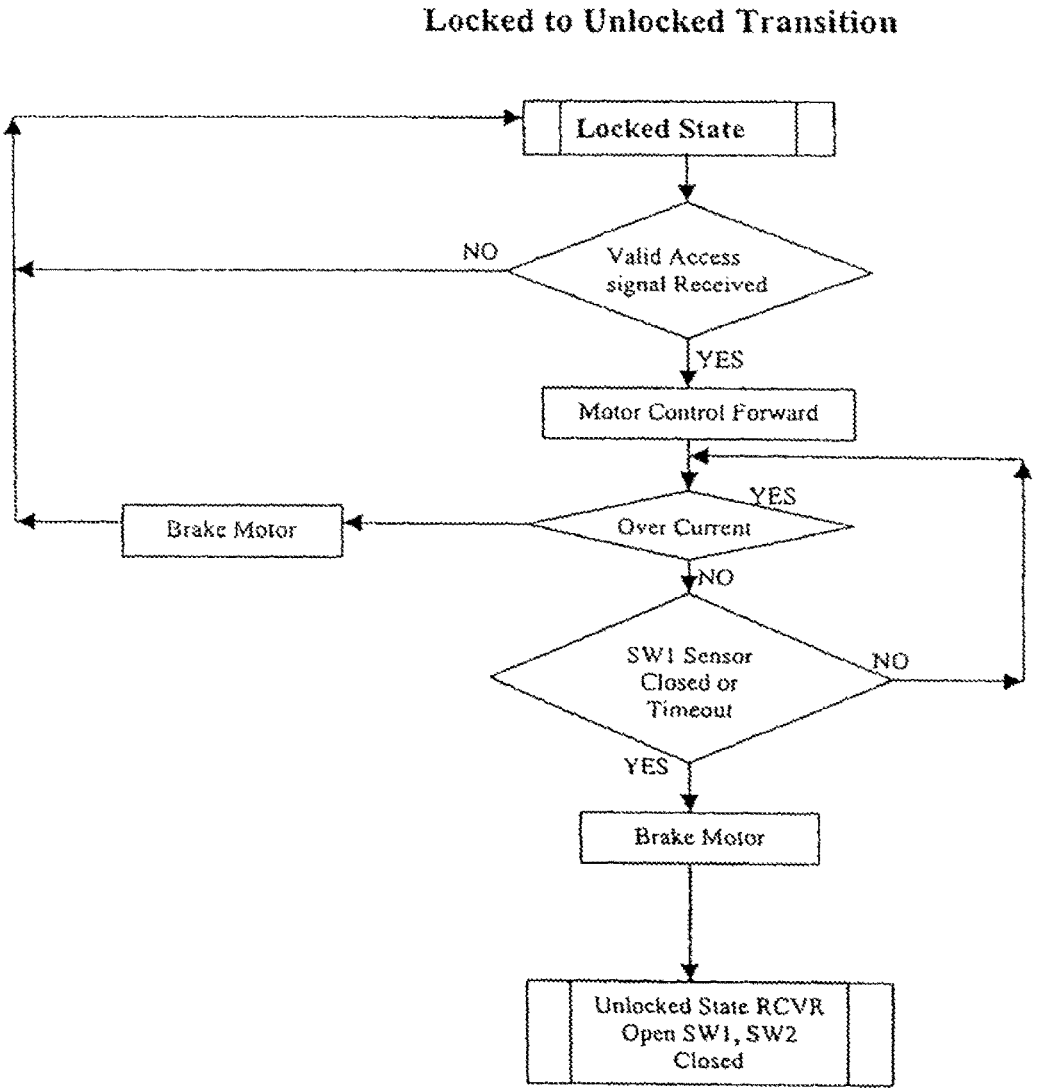
FIG. 6 is a flowchart of the locked to unlock operation.

In accordance with the present invention, an electronic control 100 interfaces to the motor 12 and position switches 102 of the motor mechanism. It will control the mechanism by a microcomputer by either driving the mechanism motor in two directions (forward and reverse) or a single direction to move the slide-bars in and out of the locked position (retracted and extended). The flow-chart drawings 6 and 7 shows a mechanism control using forward/reverse motor control and position sensors. Both the locking and unlocking modes of operations are triggered by a signal from the access control device and the controller operates the motor per the sensor switches, motor current monitoring, and timers as described. The flow-chart drawings 8 & 9 describe locking and unlocking modes of operation if a door closed and/or a receiver switch sensor is used to detect the door in the closed position to automatically trigger the locking sequence. As in FIGS. 6 & 7, the controller operates the motor per the sensor switches, motor current monitoring, and timers as described.

A further feature considers general safety of the lock operation, when the motor control unit attempts to energize the motor in order to move the slide-bar in either the locked or unlocked position and if either a slide-bar impediment or a door jam or a shorted motor condition occurs where the motor current crosses a certain limit to indicate the slide-bar is not moving, the motor control unit senses this condition and ceases to drive the motor. If this occurs at the beginning of the lock cycle (within approximately the first 30 degrees of gear rotation) the motor control unit will measure this and if it senses that the slide-bar is jammed from moving, the motor could be reversed in order to return the mechanism back to the fully retracted position. After 30 degrees of gear movement if the motor current is exceeded, the motor control will simply de-energize the motor and will not attempt to reverse the movement of the slide-bar, thus the enclosure door will remain in the locked position. If an unlock signal is later received, the motor controller will proceed to retract the slide-bar and unlock the vending machine.

In the event that a position switch is faulty, the controller is programmed with fault tolerant or default control logic to control the mechanism and allow the door to unlock if in fact a correct access code is received, even if the mechanism sensing is faulty.

Figure 7:
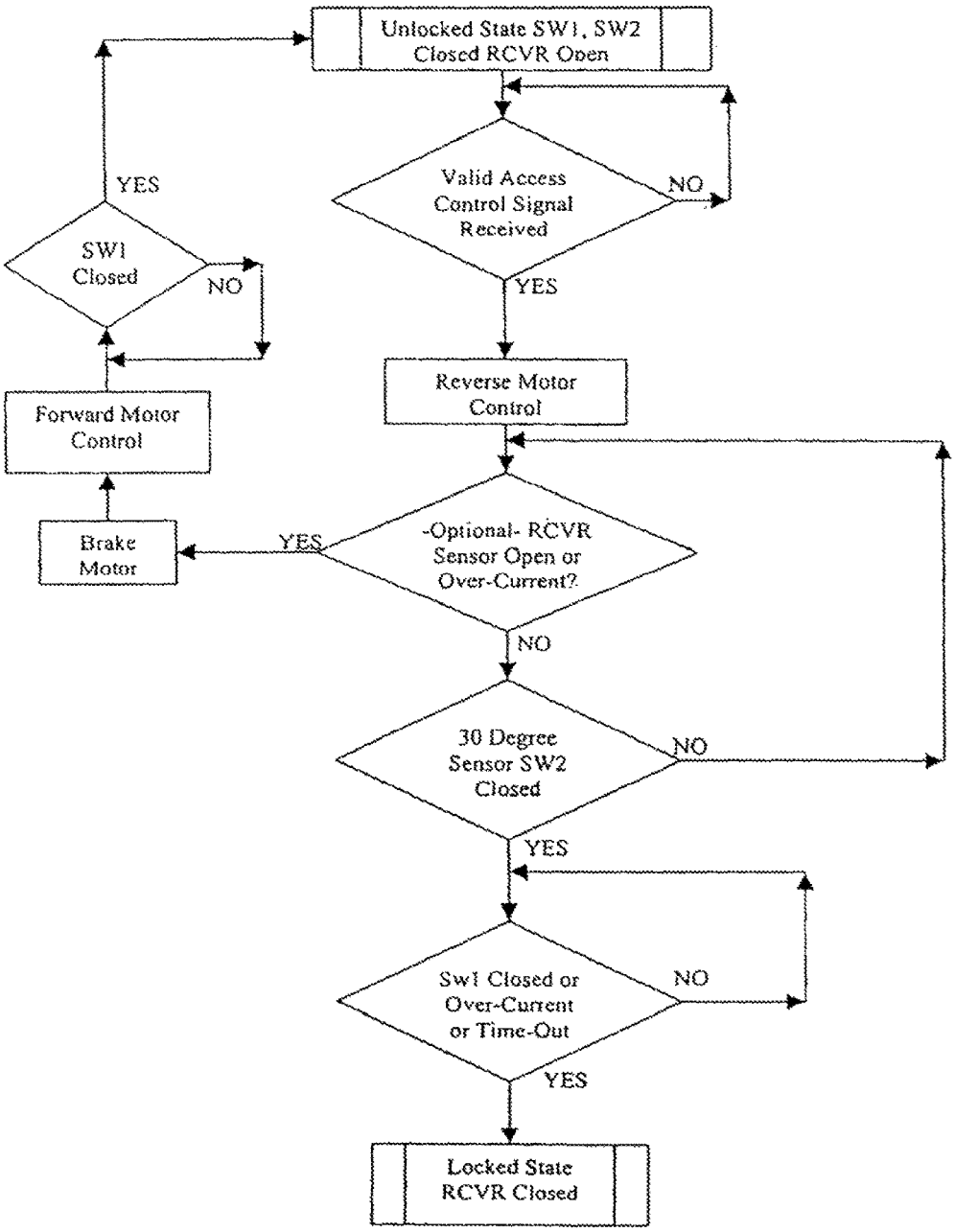
FIG. 7 is a flowchart of the unlock to lock operation.
Figure 8:
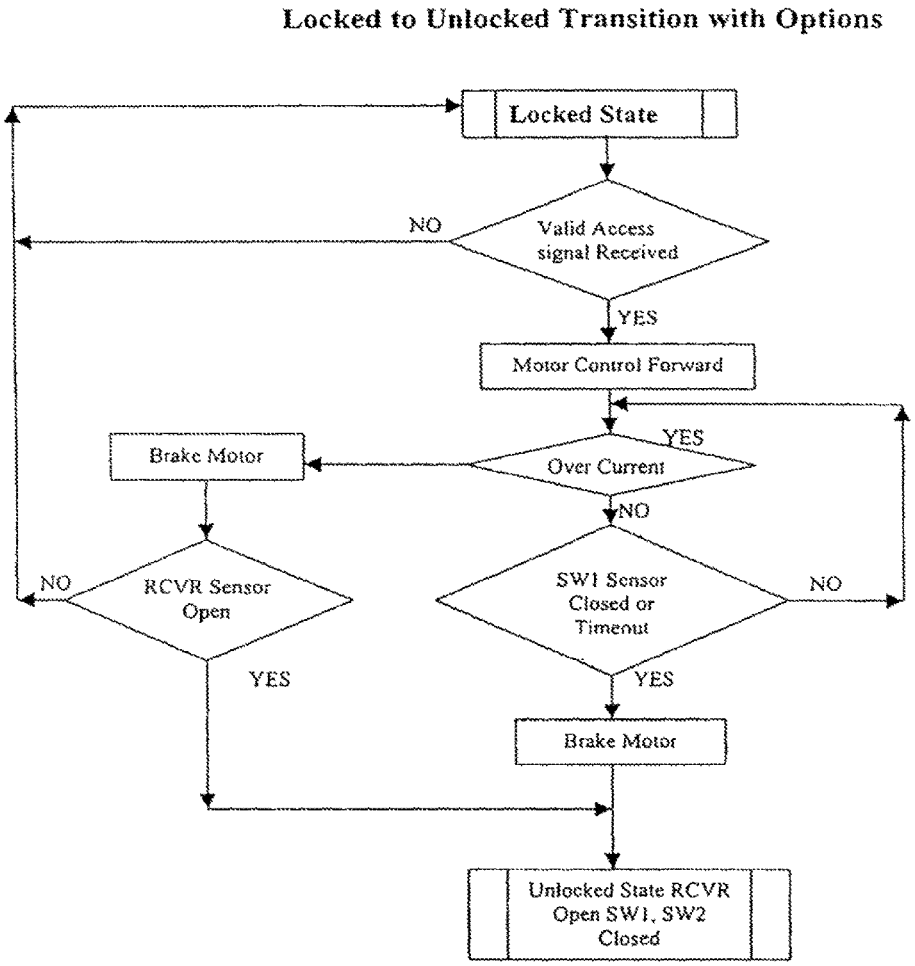
FIG. 8 is a flowchart of locked to unlocked with optional receiver sensor.
Figure 9:
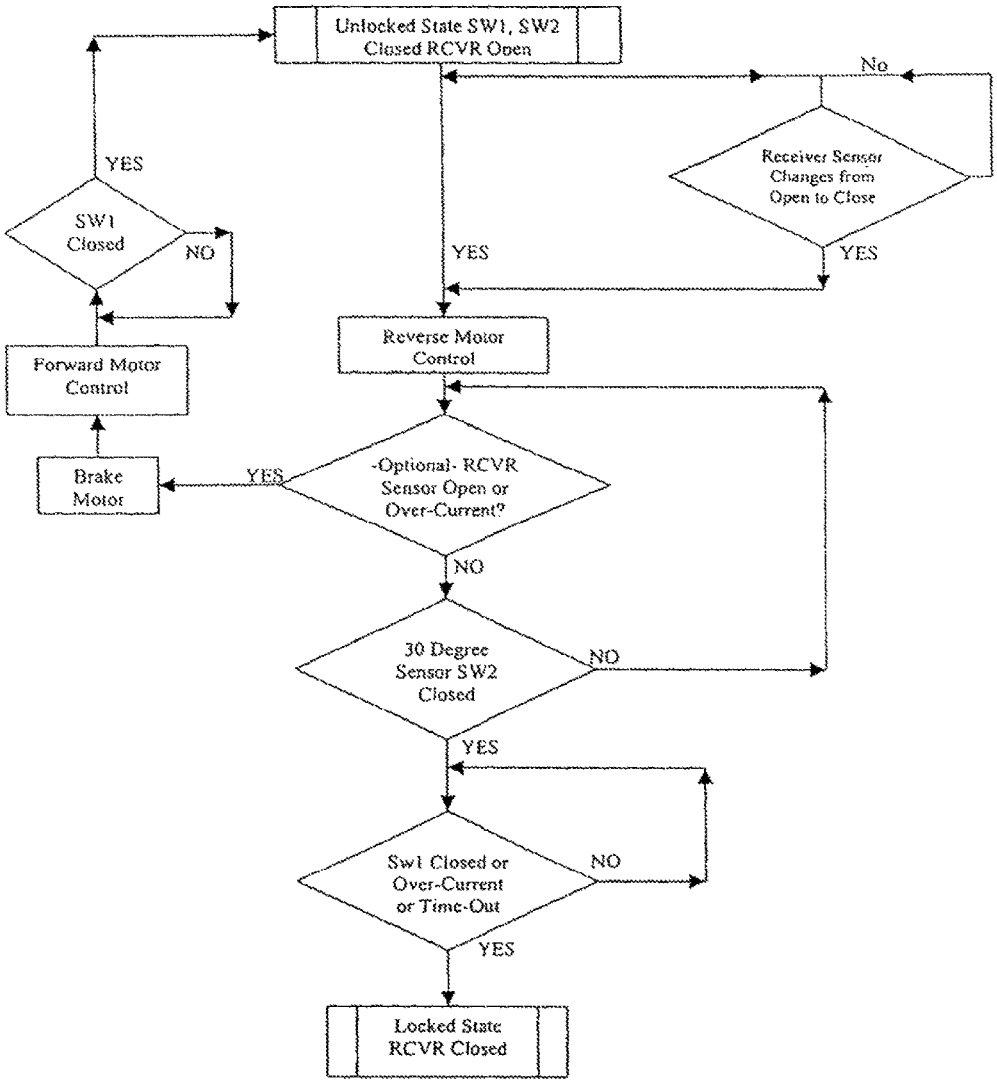
FIG. 9 is a flowchart of unlocked to locked with optional receiver sensor.
Figure 10:
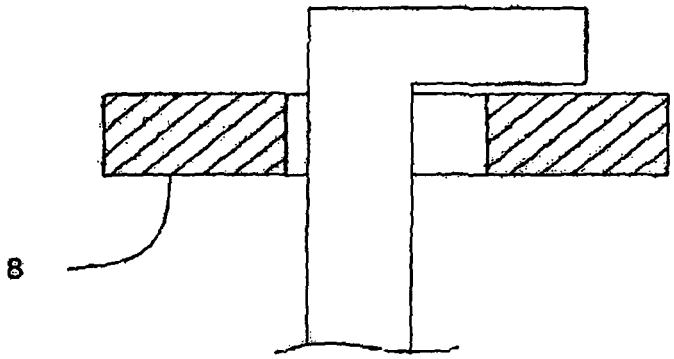
FIG. 10 is a diagram of a hook and the cross section of a slide bar.

As described in FIG. 7, in the preferred embodiment the locking event for the vending machine door is controlled by an access signal from the access control unit. In an alternative embodiment as described in FIG. 9, locking is triggered by a simple position switch which measures the position of the door, which produces the lock trigger signal when the door moves from the open to the closed position. In all cases, the access control unit (when it receives a valid access code via a keypad or a remote unit) provides the trigger to unlock the slide-bar. Examples of keypad and remote controlled access control units are described in U.S. Pat. Nos. 5,617,082, 6,359,547, and application number US2003/0234719A1.

In the case where a keypad lock mounted to the vending machine is used to access the motor control as described in the patent numbers above, the keypad lock will offer a simple user interface of keys (such as 12 access buttons) and LEI) lights and/or an LCD display to help the user enter access control commands, enter additional access codes, check the health of the battery, etc. Another alternative access control input may the vending machine selection buttons.

In the event an access control unit is desired that has no point of attack, a wireless remote control device may be used. Such a wireless access device is also described in U.S. Pat. No. 5,617,082, and this device also offers a battery-saver feature to reduce power consumption of the lock as it is waiting to receive art access code transmission. Two examples of wireless mediums used for this device are radio frequency and infrared. In radio frequency, the antenna of the access electronics must be in range of where the remote transmitter is used. In infrared, the infrared pin diode must be in optical range of where the remote transmitter is used. This battery saver feature can be utilized in a number ways: a) full-time when batteries are used to power the lock; b) not at all when the power to the lock is a DC power source; c) a combination of the two modes, wherein power saver mode is used when it is not expected that the lock will be immediately accessed or re-locked, and full-power mode when it is expected that the lock may be immediately accessed or re-locked. One less desirable feature of the battery saver feature is a time-delay reaction to the lock/unlock access input. The advantage to the dual mode of operation is to take advantage of the power-saver during the long time periods the lock most likely is not being locked or unlocked, and to take advantage of the full power mode to react the fastest to the lock/unlock access control signal.

The wireless access control device may take on one of many forms, such as a remote transmitter with a single access code transmit button. When the single transmitter button is pressed, the complete access code is instantly transmitted to the access control receiver, such as described in application US2003/0234719A1. Or alternately, the wireless device may use a biometric input such as fingerprint ID to replace a single button as the interface device.

The remote unit can also be a unit with several keypad buttons made up of several digits (for example, 0-9) to allow a user to enter multiple number of button input combinations to make up an access code. As each button is pressed, an individual unique code representing that button is transmitted to the access control unit. The order and combination of the codes received front the remote make up the access code for the vending machine. An example of such a device is known as a universal remote control unit for a television and/or other consumer electronics. Such units typically contain a 0-9 keypad; in these devices each key press results in a unique code transmission. The combination and order of the button presses (for example, 5 presses consisting of 1-3-5-7-9) will make up a unique access code transmission to the access control unit.

In the example above using the universal remote control unit, a problem exists with annunciation and user friendly operation of the lock. For example, the universal remote typically contains only an LED light indicating a button was pressed and a code was transmitted, but there is no consideration or confirmation that such key press of a particular code was received by the access control unit. Thus, this invention offers two possible solutions to this problem.

1. The access control unit can contain annunciation such as LED lights, an LCD display or an audio annunciator (just for a few examples) to provide feedback for the user as to exactly how many keypresses are being received by the remote transmitter. Note, these annunciations do not give any positive or negative feedback of whether the code received was valid or invalid, only that it was received. It will also attempt to annunciate the order that each code is received. For example, if the expected code is 5 digits in length, the annunciator may attempt to either light or unlight an LED for each code received, providing both feedbacks that the code was received and what receiving sequence this code was in as it was received. Typically, this annunciation would be located such that it can be viewed from just in front of the door (from 0 to 10 feet back from the door). In addition, other messages may be displayed such as the complete correct code was received, an incorrect complete code was received, the battery is low, an incorrect button was pressed, the mechanism should be unlocking, etc.

2. The access control unit can contain a transmission system (typically the same transmission medium as the remote unit) and the remote transmission unit can contain a wireless receiver system to receive the annunciation messages from the access control unit. The same annunciation components such as LED's, LCD, and/or audio indicators can be used at the remote unit. Thus, the user would transmit a code via the control unit, if received the access control would transmit back a confirmation to the remote unit, the remote unit will display an annunciation message to the user that the code was received. In addition, other messages may be displayed such as the complete correct code was received, an incorrect complete code was received, the battery is low, an incorrect button was pressed, the mechanism should be unlocking, etc.

This lock system can be power either by battery source or an AC or DC power source. If batteries are used, it is assumed they are mounted inside the enclosure and not accessible while the door is locked. The batteries shall be monitored for their health and the health will be measured and annunciated to the user as the enclosure is being accessed or locked (also described in U.S. Pat. No. 6,359,547). The batteries will usually be alkaline non-recharge type, although rechargeable types are possible to use.

In the event the batteries are to low to operate the unit, the preferred embodiment has a power input port that will accept a back-up power supply source to power the lock to allow the lock mechanism to unlock if a correct access code is received. This port does not provide a hotwire to over-ride the access control system of the lock. Once such battery-back-up unit is described in TriTeq U.S. patent application Ser. No. 60/523,505. Or, in some cases it may be possible to use a simple 9-volt battery.

The lock also provides an over-ride system in case the electronics fails (either the access control or the motor control unit) by providing access to the motor wires if the enclosure is drilled in a certain location. Once gaining access to these wires, the motor can be energized independent of the access control and motor control circuits and the slide-bar will retract so the door can be opened. This will allow the faulty lock components replacement without serious damage of the enclosure primary structure.

What is claimed:

1. A locking system for vending machines or cabinets wherein a door is selectively locked and unlocked to a cabinet on which the door is movably mounted, comprising in combination:

a slide mechanism linearly moveable and having either hooks or slots, the slide mechanism being carried either by the door or cabinet for selectively engaging the other of the door or cabinet having the other of the hooks or slots, a mechanical driver engaging the slide mechanism for moving the slide mechanism between a lock position and an unlock position for locking and unlocking the door to the cabinet, a gear reduction system connected to the mechanical driver for driving the mechanical driver to move the slide mechanism between the lock position and the unlock position and for imparting a resisting force to the mechanical driver which in turn transfers the resisting force to the slide mechanism, a motor connected to the gear reduction system for driving the gear reduction system, a motor control interface for actuating the motor to drive the gear reduction system to drive the mechanical driver to move the slide mechanism between the lock and unlock position so as to selectively lock and unlock the door from the cabinet; and a keyless access control device for signaling to the motor controller interface to actuate the motor.

2. The locking system of claim 1, wherein the gear reduction system comprises at least one gear positioned between the motor and the mechanical driver.

3. The locking system of claim 2, wherein the at least one gear of the gear reducing system comprises at least two gears between the motor and the mechanical driver.

4. The locking system of claim 3, wherein the gear reduction system further comprises a gear box.

5. The locking system of claim 1, wherein the movement of the slide mechanism is completely powered by the motor through the gear reduction system and the mechanical driver.

6. The locking system of claim 5, wherein power to the motor is supplied by at least one battery.

7. The locking system of claim 1, wherein the keyless access control device is an electronic remote.

8. The locking system of claim 1, wherein the keyless access control device is a removable keypad transmission device for providing an access code.

9. The locking system of claim 1, wherein the gear reduction system for imparting the resisting force to the slide mechanism comprises a helical gear, a worm gear, and a gear box.

10. A locking system for vending machines or cabinets wherein a door is selectively locked and unlocked to a cabinet on which the door is movably mounted, comprising in combination:

a slide mechanism linearly moveable and having either hooks or slots, the slide mechanism being carried either by the door or cabinet for selectively engaging the other of the door or cabinet having the other of the hooks or slots, a mechanical driver engaging the slide mechanism for moving the slide mechanism between a lock position and an unlock position for locking and unlocking the door to the cabinet, a gear reduction system connected to the mechanical driver for driving the mechanical driver to move the slide mechanism between the lock position and the unlock position and for imparting a resisting force to the mechanical driver which in turn transfers the resisting force to the slide mechanism, a motor connected to the gear reduction system for driving the gear reduction system; and a motor control interface for actuating the motor to drive the gear reduction system to drive the mechanical driver to move the slide mechanism between the lock and unlock position so as to selectively lock and unlock the door from the cabinet;

wherein the motor control interface is adapted to actuate the motor via at least two of sensor switches, motor current monitors, and timers.

11. A vending machine locking system providing for keyless entry to an interior of a vending machine, the locking system comprising:

a sliding lock mechanism linearly moveable and having hooks or slots and being positionable in a lock position and an unlock position, wherein the sliding lock mechanism is adapted to selectively engage at least one portion of the vending machine via the hooks or slots to prevent access to the interior of the vending machine when in the lock position, and is adapted to allow access to the interior of the vending machine when in the unlock position;

a motor controlled mechanism engaging the sliding lock mechanism to move the sliding lock mechanism between the lock position and the unlock position;

a gear reduction system connected to the motor controlled mechanism for driving the motor controlled mechanism and for imparting a resisting force to the motor controlled mechanism which in turn transfers the resisting force to the sliding lock mechanism, wherein the gear reduction system includes at least one gear positioned between the motor and the motor controlled mechanism;

a motor engaging the gear reduction system for moving the gear reduction system to drive the motor controlled mechanism to move the sliding lock mechanism;

an electronic motor controller for selectively actuating the motor to move the gear reduction system; and a keyless access control device for signaling to the electronic motor controller to actuate the motor.

12. The vending machine locking system of claim 11, wherein the electronic motor controller actuates the motor via at least two of sensor switches, motor current monitors, and timers.

13. The vending machine locking system of claim 11, wherein the movement of the sliding lock mechanism is completely powered by the motor through the gear reduction system and the motor controlled mechanism.

14. The vending machine locking system of claim 13, wherein power to the motor is supplied by at least one battery.

15. The vending machine locking system of claim 11, wherein the keyless access control device is an electronic remote.

16. The vending machine locking system of claim 11, wherein the keyless access control device is a removable keypad transmission device for providing an access code.

17. The vending machine locking system of claim 11, wherein the gear reduction system for imparting the resisting force to the sliding lock mechanism comprises a helical gear, a worm gear, and a gear box.

18. The vending machine locking system of claim 11, wherein the gear reduction system comprises at least two gears between the motor and the motor controlled mechanism.

19. The vending machine locking system of claim 18, wherein the gear reduction system further comprises a gear box.

20. A method for keyless entry to an interior of a vending machine or cabinet, comprising the steps of:

signaling via a keyless access control device to an electronic motor controller;

actuating a motor via the electronic motor controller;

moving a motor controlled mechanism via the motor and a gear reducing system having at least one gear positioned between the motor and the motor controlled mechanism;

selectively linearly moving a sliding lock mechanism, having hooks or slots, between a lock position and an unlock position via the motor controlled mechanism, wherein the sliding lock mechanism selectively engages at least one portion of the vending machine via the hooks or slots to prevent access to the interior; and reducing motor rotation via the gear reducing system to impart a resisting force to the motor controlled mechanism and through to the sliding lock mechanism.

21. The method of claim 20, wherein the step of actuating the motor via the electronic motor controller further comprises utilizing at least two of sensor switches, motor current monitoring, and timers.

22. The method of claim 20, wherein the movement of the sliding lock mechanism is completely powered by the motor through the gear reducing system and the motor controlled mechanism.

23. The locking system of claim 22, wherein power to the motor is supplied by at least one battery.

24. A method for keyless entry to an interior of a vending cabinet having a door movably mounted to the vending cabinet, comprising the steps of:

providing a sliding lock mechanism carried by either the door or the vending cabinet, the sliding lock mechanism having at least one hook or at least one slot;

signaling via a keyless access control device to an electronic motor controller;

actuating a motor via the electronic motor controller;

moving a motor controlled mechanism via the motor and a gear reducing system having at least one gear positioned between the motor and the motor controlled mechanism;

selectively moving the sliding lock mechanism between one of a lock position and an unlock position via the motor controlled mechanism such that the at least one hook or at least one slot of the sliding lock mechanism selectively engages with the at least one slot or at least one hook carried by the other of the door or the vending cabinet, so as to prevent access to the interior of the vending cabinet while in the lock position; and reducing rotation, produced by the motor when the motor is actuated, via the gear reducing system and imparting a resisting force from the gear reducing system to the motor controlled mechanism and there through to the sliding lock mechanism to resist an external prying force from moving the sliding lock mechanism out of the lock position.

* * * * *